United States Patent [19]

Behr et al.

[11] Patent Number: 4,829,745

[45] Date of Patent: May 16, 1989

[54] TUBE SPREADER FOR REMOVING WRINKLES IN TUBE STOCK

[75] Inventors: R. Douglas Behr; Larry M. Zieke, both of Midland, Mich.

[73] Assignee: The Dow Chemical Company, Midland, Mich.

[21] Appl. No.: 129,504

[22] Filed: Dec. 7, 1987

[51] Int. Cl.[4] ..... B65B 9/08; B65B 9/20

[52] U.S. Cl. ..... 53/451; 53/551

[58] Field of Search ..... 53/451, 551, 552, 389, 53/550, 373

[56] References Cited

U.S. PATENT DOCUMENTS

| | | | |
|---|---|---|---|
| 3,492,775 | 2/1970 | Rhine et al. | 53/451 |
| 3,795,081 | 3/1974 | Brown, Jr. et al. | 53/451 |
| 3,815,317 | 6/1974 | Toss | 53/551 X |
| 4,073,121 | 2/1978 | Greenawalt et al. . | |
| 4,235,064 | 11/1980 | Wenger | 53/451 |
| 4,291,520 | 9/1981 | Prince . | |
| 4,355,494 | 10/1982 | Tilman . | |
| 4,506,494 | 3/1985 | Shimoyama et al. . | |
| 4,534,159 | 8/1985 | Kelly | 53/451 X |
| 4,589,247 | 5/1986 | Tsuruta et al. | 53/551 X |
| 4,617,683 | 10/1986 | Christoff . | |
| 4,640,083 | 2/1987 | Takahashi et al. | 53/551 |
| 4,641,486 | 2/1987 | Lannoni . | |
| 4,697,403 | 10/1987 | Simpson et al. | 53/551 |
| 4,698,954 | 10/1987 | Behr et al. | 53/551 |

*Primary Examiner*—Horace M. Culver

[57] ABSTRACT

An improved tube spreader for flattening and removing wrinkles from a bag film web in a form, fill, and seal packaging machine is provided. The tube spreader includes a plurality of clamping fingers which grasp a first edge of the bag film and a spreader bar, located within the bag film, and adapted to exert a lateral force on the opposite edge of the film to eliminate and remove wrinkles prior to the film being sealed.

23 Claims, 2 Drawing Sheets

TUBE SPREADER FOR REMOVING WRINKLES IN TUBE STOCK

BACKGROUND OF THE INVENTION

This invention relates to a method and apparatus for forming, filling, and sealing plastic bags or containers with various materials, and more particularly to a method and apparatus for eliminating the wrinkles that would otherwise form at the heat sealed seams of the plastic films used to form the bags or containers.

In recent years, processing machinery has been developed for filling plastic bags, pouches, and containers with dry particulate products or with liquid products. Typically, this machinery is referred to as vertical form, fill, and seal machinery because of the manner in which the bags are formed and then filled with product. Generally with such machines, a flat continuous roll of bagging material may be formed into a tube, sealed at the bottom, filled with product, and then sealed at the top. Examples of such machines and methods are numerous and include U.S. Pat. Nos. 3,826,061; 3,849,965; 4,077,308; and 4,090,344.

In typical vertical form, fill, and seal machines, a flat sheet of packaging material is first formed into a tube by automatically shaping the sheet into a tube, bringing the edges of the sheet together, and longitudinally sealing those edges at that juncture. A pair of sealing jaws are provided in the machine which are transversely movable toward each other to engage the bagging material, after it is in the shape of a tube, to form a transverse seal providing the upper closure for a lower bag and a bottom closure for a succeeding bag. The product to be placed in the bag is measured and introduced into the upper succeeding bag. Then, the sealing jaws are released and the bagging material is advanced. The sealing jaws are reactivated and again engage the bagging material to form an upper seal on the just-filled bag, and the procedure is repeated again and again. After sealing, individual bags are separated by a suitable severing mechanism.

In some cases, the bags, pouches, or containers are reclosable. That is, the bags include along one edge thereof mating rib and groove profile elements. Such reclosable zippered bags have been adapted for use in vertical form, fill, and seal machinery. See, for example, U.S. Pat. Nos. 4,617,683; 4,355,494; and 3,815,317. In those patents, the flat bag stock is manipulated by appropriate handling apparatus to fold it, mate the corresponding rib and groove elements to form a tube, and then the tube is handled in a manner conventional in vertical form, fill, and seal machinery.

One of the problems which has occurred in the past with vertical form, fill, and seal machinery has been that wrinkles tend to form along the edge seal lines of the bags during the edge seal operation. This wrinkling problem is due in large part to the fact that the bag tube, once filled with product, assumes and maintains a tubular shape. When the jaws of the sealing mechanism close about the tube stock, the presence of product in the tube causes the tube to resist flattening. Because of the lack of control over the movement of the edges, and their resistance to assuming a flat configuration, it is likely that wrinkles will form as the sealing jaws close and form the seal.

Attempts have been made in the past to overcome this wrinkling problem in conventional tube stock. For example, Wenger, U.S. Pat. No. 4,235,064, shows a vertical form, fill, and seal machine which includes a centerfold rod which is spring loaded to bear against the center line of the tube during filling and sealing thereof. Kelly, U.S. Pat. No. 4,534,159, teaches a form, fill, and seal apparatus which includes two pairs of stretcher fingers at opposite sides of the tube stock to provide opposing forces in directions perpendicular to the movement of the sealing jaws to flatten the tube prior to sealing.

The wrinkling problem is, if anything, even more of a problem where the tube stock is of reclosable bag material. The presence of the mated rib and groove elements at one side of the tube after filling the tube with product contributes to the difficulties in getting the opposing tube surfaces into a flattened configuration for sealing. Accordingly, the need exists in this art for a method and apparatus for removing the wrinkles from zippered tube stock prior to sealing.

SUMMARY OF THE INVENTION

The present invention meets that need by providing a tube spreader in a vertical form, fill, and seal packaging machine which effectively flattens the edges of a tube of reclosable bag film containing product. In accordance with one aspect of the present invention, a tube spreader for flattening and removing wrinkles from a bag film web is provided which includes means for securing without sealing a a first edge of the bag film. Such securing means comprise a plurality of clamping fingers.

A spreader bar, which is located within the tubular bag film, is adapted to exert a lateral force on a second edge of the bag film opposite the first edge. When that lateral force is exerted, the opposing plies of the bag film pass around the spreader bar until the movement of the spreader bar pulls both opposing plies tight, flattening the bag film and removing wrinkles therefrom along the upper edge of the bag film which is to be sealed.

While the method and apparatus of the present invention is effective in flattening and removing wrinkles from tubular film stock, it is especially effective in handling reclosable bag film stock having interlocking rib and groove elements along one edge thereof. Accordingly, the invention will be described further with reference to packaging machinery specially adapted for handling reclosable bag film stock.

The bag film web may be provided to the vertical form, fill, and seal machinery in a variety of ways. For example, it may be provided as a flat web with the rib and groove profile elements being disposed on opposite edges of the web. The web is then formed into a tubular configuration and the profile elements interlocked. Alternatively, the bag film may be provided with the rib and groove profile elements already interlocked on opposing plies of the bag film. The bag film is then spread apart into a tubular configuration.

In the vertical form, fill, and seal machine, the bag film is fed to a filling station where a first transverse seal is formed along what will become the lower edge of the bag. A product, in either a granular or liquid form, is added through a filling tube in a predetermined amount to the bag film. The bag film is then advanced through the filling station to position it to be sealed along its upper edge.

The tube spreader of the present invention is then activated. A plurality of opposing clamping fingers engage a first upper edge of the bag film adjacent the interlocking fastener elements. The spreader bar, located within the filling tube, is then activated to move transversely toward a second upper edge of the bag film opposite the first edge. As the spreader bar moves, it smooths out and flattens any wrinkles along the upper edge of the film. The spreader bar moves transversely until it exerts a lateral force on the second edge of the bag film. Because the opposing plies of the film are free to slip around the spreader bar, any unevenness between opposing plies is eliminated.

Once flattened and any wrinkles removed, the upper edge of the bag film is then heat sealed to form a bag assembly having first and second side seams. The bag assembly may then be severed from the bag film stock in a conventional manner.

Accordingly, it is an object of the present invention to provide a tube spreader which is effective to flatten product-filled zippered bag film and remove the wrinkles therefrom prior to lateral heat sealing of the film in a vertical form, fill, and seal machine. This, and other objects and advantages of the invention, will become apparent from the following detailed description, the accompanying drawings, and the appended claims.

DETAILED DESCRIPTION OF THE PREFERRED EMBODIMENTS

Figure 1:
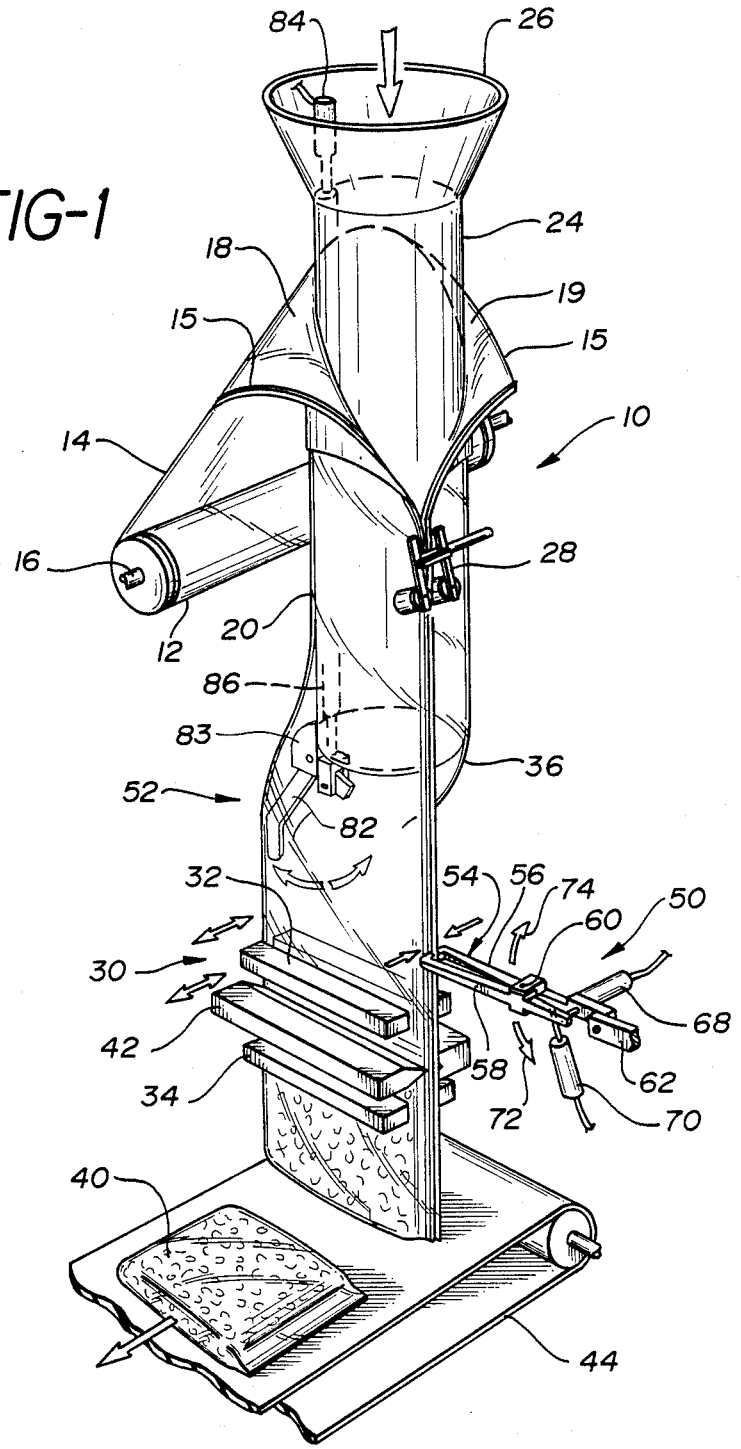
FIG. 1 is a perspective view of the form, fill, and seal packaging machine with the tube spreader of the present invention.

Referring now to FIG. 1, a form, fill, and seal packaging machine is illustrated. The packaging machine 10 includes a means, such as bag film roll 12, for supplying a continuous web 14 of plastic bag film. For purposes of description, bag film 14 is shown as having reclosable interlocking closure elements 15 and 15' thereon. However, it will be understood that the present invention has applicability to tubular bag films and the like.

Bag film roll 12 is supported on a spindle 16 which is rotatably journaled to a rack (not shown) for maintaining the roll 12 off the ground. The continuous web 14 of bag film is unwound from roll 12 and is fed into the form, fill, and seal portions of packaging machine 10.

Because of the additional thickness caused by the interlocking closure elements, the web 14 is helically wound onto roll 12. As drawn from roll 12, web 14 has a pair of opposed plies 18 and 19. The opposed plies 18, 19 are continuous with each other at the bottom edge 20 of the web. Interlocking closure elements 15 and 15' comprise respective rib and groove elements which are formed as part of each respective ply or are otherwise secured thereto. The closure elements permit the finished bag to be reclosed after opening.

From the roll 12, the web 14 is drawn over a forming collar (not shown) by a feed mechanism (not shown) which is located downstream in the path of travel of the web. Web 14 is then drawn about a filling chute 24 having a frustoconical opening 26. Granular or liquid food products, or other granular material are added through opening 26. The tubular shape of the chute causes the web to assume roughly the same shape as it passes around the chute 24. While a vertical, tubular filling chute is shown, it will be understood that other filling chute structures may be utilized. For example, a side filling chute such as the one described in U.S. application Ser. No. 889,551, filed July 25, 1986, and commonly assigned, now U.S. Pat. No. 4,698,954 may be utilized.

Once it has passed over forming collar (not shown), the web 14 travels generally vertically downwardly. A steering, joining, and closing mechanism 28 for pressing together and interlocking the rib and groove elements 15, 15' of opposed plies 18, 19 is disposed in the path of travel of web 14 as the web passes around tubular filing chute 24. The steering, joining, and closing mechanism 28 serves to secure the opposing plies together to form a tubular web which is then filled as described in greater detail below. Details of the operation of mechanism 28 are set forth in U.S. application Ser. No. 889,571, filed July 25, 1986, and commonly assigned now U.S. Pat. No. 4,727,709. Generally, mechanism 28 includes a pair of opposing press rolls which are at an angle to the direction of travel of web 14. This tends to pull the opposing plies 18, 19 taut against filling chute 24 and bring the interlocking closure elements 15, 15' into proper alignment for securing them together.

Optionally, a seal forming bar (not shown) may be located downstream of mechanism 28. Such a seal forming bar provides a temporary "peel seal" formed interiorly of, and generaly parallel to, closure elements 15,15'. The peel seal can be opened by the user without destroying the integrity of the package material while serving to render the package more tamper resistant.

A reciprocally moving, generally horizontally disposed seal forming apparatus 30 having sealing bar elements 32 and 34 is disposed below the open lower end 36 of filling chute 24. Preferably, seal forming apparatus 30 is disposed at a distance below open lower end 36 approximately equal to the width of a finished package 40. Sealing bar elements 32 and 34 laterally seal together first and second plies 18,19 of the web 14 to form the side seals for finished package 40.

A severing device 42 is located between the sealing bar elements 32 and 34. Severing device 42 severs the intermittently sealed continuous web 14 into individual packages 40. Packages 40 may be transferred to a further processing or packing station by, for example, conveyor belt 44.

Positioned between the open lower end 36 of filling chute 24 and seal forming apparatus 30 is tube spreader 50. Tube spreader 50 comprises two portions, namely a spreader bar portion 52 and a clamping fingers portion 54. Spreader finger portion 54 includes a pair of fingers 56,58 pivotally mounted at pivot point 60 and adapted to clamp opposing plies 18,19 of web 14 near closure elements 15,15'.

Figure 2:
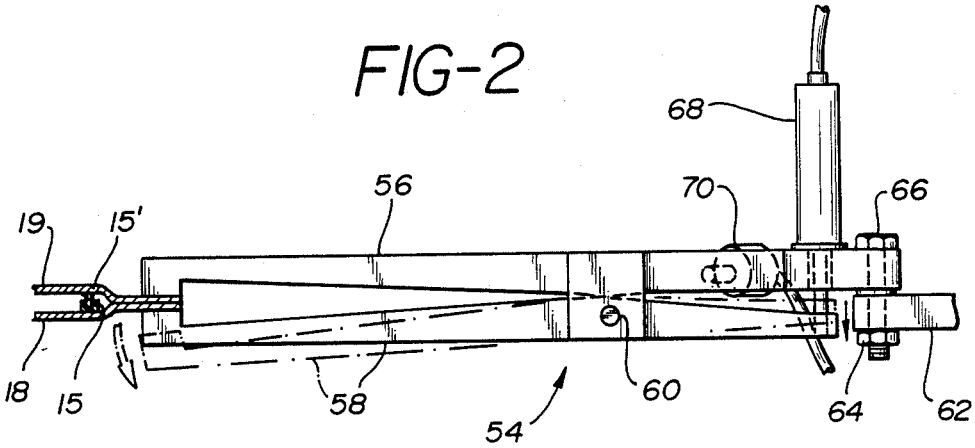
FIG. 2 is a top plan view of the spreader fingers of the present invention.

Preferably, as is best shown in FIG. 2, the fingers 56,58 clamp the web exteriorly of the closure elements on the portion of the web material which will become the lips of the finished packages. Preferably, finger portion 54 is mounted directly onto the vertical form, fill, and seal machine frame rather than the seal forming assembly. This is shown by securing finger portion 54 to a part of frame 62 by suitable means such as nut 64 and bolt 66.

Means 68, such as an air actuated cylinder, are provided to cause fingers 56,58 to close immediately after web 14 stops its downward movement through the machine 10 and before sealing bar elements 32,34 close. Conventional timing and control means (not shown) coordinates the movement of the web, operation of the fingers and spreader bar, and operation of the sealing apparatus. In operation, immediately after the sealing bar elements 32, 34 close, fingers 56, 58 can be opened (as shown in phantom in FIG. 2) again by actuating air cylinder 68.

Because the elapsed time between the closing and reopening of the fingers is short, and must be coordinated with the stoppage of downward movement of the web 14, it is important that the operation of the fingers be controlled precisely. To aid in the operation, and to provide some flexibility to the operation, finger portion 54 may be optionally provided with a degree of freedom which permits the fingers to move downwardly in accompaniment with the downward movement of the sealing bar elements immediately after they close.

A second air-actuated cylinder 70 operates to move finger portion 54 in the direction of arrows 72 and 74. Thus, in operation, finger portion 54 is closed by the actuation of air cylinder 68 and then is moved downwardly in accompaniment with the downward movement of sealing bar elements 32,34. The fingers 56,58 are then opened, and finger portion 54 returned to its initial position. Optionally, finger portion 54 can also be moved laterally away from the web once fingers 56,58 are closed to impart a spreading and flattening motion to web 14. However, this has not been found to be necessary as the spreader bar 52 imparts a sufficient spreading and flattening to the web.

Figure 3:
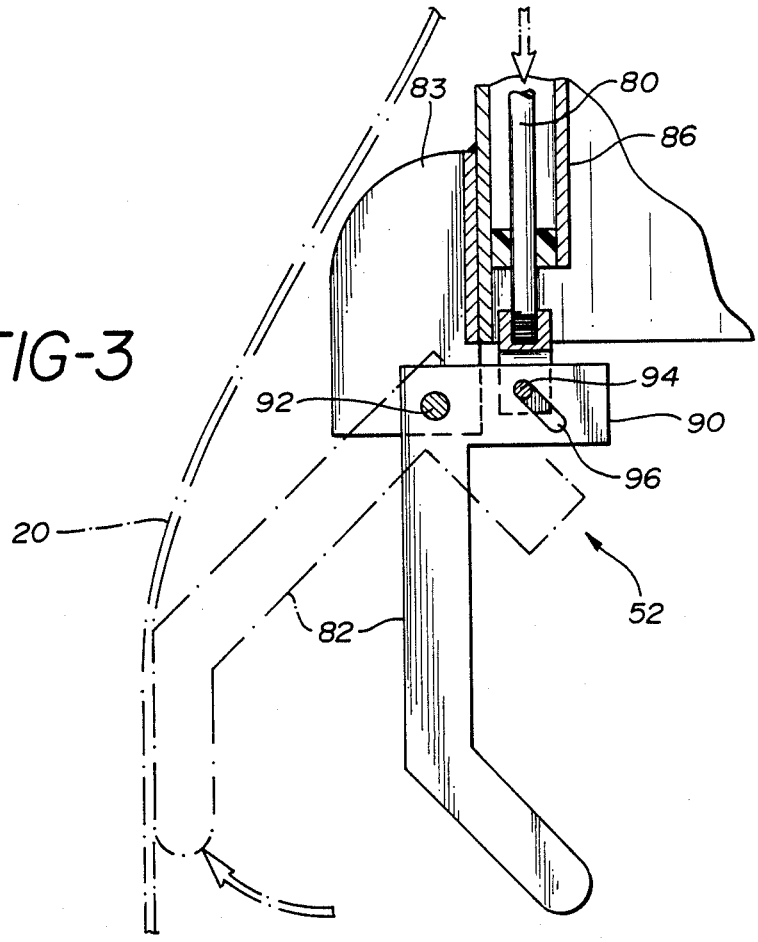
FIG. 3 is an enlarged sectional view showing the detail of the operation of the spreader bar of the present invention.

The other main component of the tube spreader is the spreader bar portion 52. Spreader bar portion 52, as best shown in FIG. 3 includes an elongated, vertically extending rod portion 80 which is pivotally mounted on filling chute 24. As shown, a spreader bar 82 is mounted on plate 83 which is secured to the exterior of chute 24. Spreader bar 82 includes a lever arm 90 which pivots about point 92. The spreader bar 82 itself extends downwardly to a point below the open end 36 of filling chute 24. An air cylinder 84, or other suitable actuation device, serves to cause rod 80 to move downwardly thereby causing the spreader bar 82 to move laterally outwardly against web 14 as shown in phantom in FIG. 3. That is, translation of rod 80 downwardly in the direction shown by the arrow causes pin 94 to move within elongated slot 96 and actuates movement of lever arm 90 as shown in phantom. This in turn causes spreader bar 82 to move outwardly in the direction shown by the arrow to pull web 14 taut.

Preferably, the spreader bar portion 52 is enclosed in chute 24 by a protective shroud 86 which may be a strip of sheet metal or the like, semicircular in cross-section which extends downwardly along an inner wall of chute 24. Shroud 86 acts to prevent contamination of the granular feed material introduced into the filling chute as well as protecting spreader bar portion 52 from being jammed by an accumulation of feed material.

In operation, just after finger 54,56 are actuated to clamp onto web 14 near closure elements 15,15', and prior to sealing bar elements 32,34 closing, the spreader bar 82 is caused to move laterally outwardly to pull web 14 taut. If the lateral length of plies 18,19 of web 14 from the respective rib and groove closure elements are initially unequal, web 14 will slip around bar 82. Once the two lengths of opposing plies are equal, both will become taut as the bar 82 is moved laterally.

Preferably, bar 82 extends through filling chute 24 and terminates immediately adjacent upper sealing bar element 32. While bar 82 is holding web 14 taught and removing wrinkles therefrom, sealing bar elements 32,34 are closed to form the side seals on packages 40. Immediately after the sealing bar elements close, air cylinder 70 is actuated to cause the spreader bar 82 to move back to its initial position, relaxing the lateral stress on the web. This permits the web to accept additional product. Once the feed material is added to the succeeding portion of web material, the cycle is repeated.

Because of the opposing arrangement of finger portion 54 and spreader bar portion 52, the web material can be firmly grasped at one side, while permitting it to be pulled taut in a manner that eliminates wrinkle formation from the opposite side. Because opposing plies of the web are free to slip around the spreader bar, any unevenness between plies is eliminated, and the web material is pulled taut prior to sealing.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A form, fill, and seal packaging machine comprising:

means for supplying a continuous bag film web having interlocked reclosable fastener elements on respective opposing plies of said bag film, means for feeding said bag film to a filling station, a filling station for supplying a predetermined amount of product to said bag film, said filling station including a filling tube, a tube spreader for flattening and removing wrinkles from said bag film, said tube spreader comprising means for securing without sealing a first edge of said bag film adjacent said fastener elements, and a spreader bar located with said bag film and adapted to exert a lateral force on a second edge of said bag film opposite said first edge, means for laterally sealing said bag film to form a bag assembly having first and second side seams, and means for severing said bag assembly from said bag film web.

2. The packaging machine of claim 1 in which said bag film includes a lip portion exteriorly of said fastener elements and in which said securing means include a plurality of clamping fingers to secure said lip portion of said bag film.

3. The packaging machine of claim 2 including means for closing said clamping fingers on said first edge.

4. The packaging machine of claim 2 including means for moving said clamping fingers downwardly.

5. The packaging machine of claim 1 in which said spreader bar extends through said filling tube and terminates immediately above said lateral sealing means.

6. The packaging machine of claim 1 in which said tube spreader includes means for translating said spreader bar from a first resting position to a second position exerting a lateral force on said second edge of said bag film.

7. A tube spreader for flattening and removing wrinkles from a bag film web in a form, fill, and seal packaging machine comprising:

means for securing without sealing a first edge of said bag film, and a spreader bar located within said bag film and adapted to exert a lateral force on a second edge of said bag film opposite said first edge, whereby wrinkles are flattened and removed from said bag film.

8. The tube spreader of claim 7 in which said bag film includes a lip portion exteriorly of said fastener elements and in which said securing means include a plurality of clamping fingers to secure said lip portion of said bag film.

9. The tube spreader of claim 8 including means for closing said clamping fingers on said first edge of said bag film.

10. The tube spreader of claim 8 including means for moving said clamping fingers downwardly.

11. The tube spreader of claim 7 in which said spreader bar is positioned immediately above a lateral sealing means for said bag film.

12. The tube spreader of claim 7 in which said tube spreader includes means for translating said spreader bar from a first resting position to a second position exerting a lateral force on said second edge of said bag film.

13. A method for flattening and removing wrinkles from a bag film web during a form, fill, and seal packaging operation comprising the steps of:

providing a continuous bag film web having interlocked reclosable fastener elements on respective opposing plies of said bag film web.

spreading apart said opposing plies to form a vertically upwardly opening tube, laterally sealing said tube to form a first side seam, filling a portion of said tube above said first side seam with a product, flattening said tube at a point above said product by securing without sealing a first edge of said tube adjacent said fastener elements with a plurality of clamping fingers and translating a spreader bar located within said tube laterally to exert a force on a second edge of said tube opposite said first edge to flatten and remove wrinkles in said tube, laterally sealing said tube at a point adjacent said plurality of spreader fingers to form a bag assembly, and severing said bag assembly from said tube.

14. A form, fill, and seal packaging machine comprising:

means for supplying a continuous bag film web having interlocked reclosable fastener elements on respective opposing plies of said bag film, a generally vertical filling tube for supplying a predetermined amount of product to said bag film, a tube spreader positioned downstream of said filling tube for flattening and removing wrinkles from said bag film, said tube spreader comprising means for engaging without sealing a first edge of said bag film adjacent said fastener elements, and means for exerting a lateral force on a second edge of said bag film opposite said first edge to flatten said film and remove wrinkles therefrom, means for laterally sealing said bag film to form a bag assembly having first and second side seams, and means for severing said bag assembly from said bag film web.

15. The packaging machine of claim 14 in which said means for engaging said first edge of said bag film include a plurality of clamping fingers.

16. The packaging machine of claim 14 in which said means for exerting a lateral force on said second edge of said bag film include a spreader bar located within said bag film.

17. A form, fill, and seal packaging machine comprising:

means for supplying a continuous bag film web having interlocked reclosable fastener elements on respective opposing plies of said bag film, a generally vertical filling tube for supplying a predetermined amount of product to said bag film, means for laterally sealing said bag film to form a bag assembly having first and second side seams, means for severing said bag assembly from said bag film web, and a tube spreader positioned downstream of said filling tube for flattening and removing wrinkles from said bag film, said tube spreader comprising means for engaging a first edge of said bag film adjacent said fastener elements, and a spreader bar, extending through said filling tube and terminating immediately above said lateral sealing means, for exerting a lateral force on a second edge of said bag film opposite said first edge to flatten said film and remove wrinkles therefrom.

18. The packaging machine of claim 17 in which said means for engaging said first edge of said bag film include a plurality of clamping fingers.

19. A form, fill, and seal packaging machine comprising:

means for supplying a continuous bag film web having interlocked reclosable fastener elements on respective opposing plies of said bag film, a generally vertical filling tube for supplying a predetermined amount of product to said bag film, a tube spreader positioned downstream of said filling tube for flattening and removing wrinkles from said bag film, said tube spreader comprising means for engaging a first edge of said bag film adjacent said fastener elements, means for moving said engaging means downwardly, and means for exerting a lateral force on a second edge of said bag film opposite said first edge to flatten said film and remove wrinkles therefrom, means for laterally sealing said bag film to form a bag assembly having first and second side seams, and means for severing said bag assembly from said bag film web.

20. The packaging machine of claim 19 in which said means for engaging said first edge of said bag film include a plurality of clamping fingers.

21. The packaging machine of claim 19 in which said means for exerting a lateral force on said second edge of said bag film include a spreader bar located within said bag film.

22. A tube spreader for flattening and removing wrinkles from a bag film web in a form, fill, and seal packaging machine comprising:

means for securing without sealing a first edge of said bag film, means for moving said securing means downwardly, and a spreader bar located within said bag film and adapted to exert a lateral force on a second edge of said bag film opposite said first edge, whereby wrinkles are flattened and removed from said bag film.

23. The tube spreader of claim 22 in which said bag film includes a lip portion exteriorly of said fastener elements and in which said securing means include a plurality of clamping fingers to secure said lip portion of said bag film.

* * * * *